United States Patent [19]

Herbers et al.

[11] Patent Number: 5,044,184

[45] Date of Patent: Sep. 3, 1991

[54] LOCK

[75] Inventors: Michael Herbers, Telgte; Karl-Heinz Spahn, Ostbevern; Anton Uekötter, Telgte; Dieter Wienert, Senden, all of Fed. Rep. of Germany

[73] Assignee: Aug. Winkhaus GmbH & Co. Kg

[21] Appl. No.: 421,653

[22] Filed: Oct. 16, 1989

[30] Foreign Application Priority Data

Oct. 17, 1988 [DE] Fed. Rep. of Germany ..... 3835349
Sep. 28, 1989 [EP] European Pat. Off. ..... 89117975.6

[51] Int. Cl.[5] ..... E05B 47/00

[52] U.S. Cl. ..... 70/277; 70/107; 70/370

[58] Field of Search ..... 70/277-279, 70/370, 371, 107-111, 134, 120, 486, 487, 118, 119, 150, 467

[56] References Cited

U.S. PATENT DOCUMENTS

| | | | |
|---|---|---|---|
| 3,148,525 | 9/1964 | Durant | 70/107 |
| 3,242,706 | 3/1966 | Check | 70/110 |
| 3,266,276 | 8/1966 | Yulkowski | 70/110 |
| 3,672,714 | 6/1972 | Schultz | 70/107 X |
| 3,769,822 | 11/1973 | Yulkowski | 70/107 |
| 3,992,908 | 11/1976 | Crepinsek | 70/370 |
| 4,037,440 | 7/1977 | Shabtai et al. | 70/120 X |
| 4,572,556 | 2/1986 | Foshee | 70/107 X |
| 4,730,471 | 3/1988 | Seckinger et al. | 70/277 |
| 4,840,050 | 6/1989 | Gotanda | 70/107 |

FOREIGN PATENT DOCUMENTS

| | | |
|---|---|---|
| 0200912 | 12/1986 | European Pat. Off. . |
| 0235703 | 9/1987 | European Pat. Off. . |
| 1033082 | 6/1952 | Fed. Rep. of Germany . |
| 2361307 | 9/1975 | Fed. Rep. of Germany . |
| 2919201 | 11/1980 | Fed. Rep. of Germany . |
| 3514147 | 10/1986 | Fed. Rep. of Germany . |
| 3620799 | 2/1987 | Fed. Rep. of Germany . |
| 3707284 | 9/1988 | Fed. Rep. of Germany . |
| 3742153 | 6/1989 | Fed. Rep. of Germany . |
| 2183718 | 6/1987 | United Kingdom . |

*Primary Examiner*—Gary L. Smith
*Assistant Examiner*—Suzanne L. Dino
*Attorney, Agent, or Firm*—Toren, McGready & Associates

[57] ABSTRACT

The profiled cylinder (38) seated in an insertion opening (87) of the lock housing (7) is guided by a retaining bracket (93) and fixed centrally by a detent pin (121) on the retaining bracket (93). The detent pin (121) is guided displaceably on a slide piece (103) and initially stressed by a spring (131) towards the profiled cylinder (38). The profiled cylinder (38) contains a reading device for en electronic key, which device is connected through a plug-in connection (89) with an electronic circuit of the lock. The plug-in connection (89) and the detent pin (121) are so adapted to one another that the detent pin (121) firstly fixes the profiled cylinder (38) on the pedestal (93) before the slide piece (103) guided in centered manner in relation to the pedestal (93) closes the plug-in connection (89). In this way defects of alignment of the plug-in connection (89) and damage to its contact elements (107, 109) are avoided.

19 Claims, 7 Drawing Sheets

LOCK

BACKGROUND OF THE INVENTION

The invention relates to a lock, and particularly to an electrically controllable lock.

From EP-A-200,912 an electrically controllable door lock is known which is blockable by means of a profiled lock cylinder held in a correspondingly shaped insertion opening of its lock housing. The profiled cylinder has as usual an axially extending key passage in its cylinder part for the reception of the key, and a flange protrudes radially from the cylinder part. In the lock housing an electronic control circuit is contained which is connected by way of several electrical contact elements with a reading device accommodated in the profiled cylinder. The reading device detects control information of the key, for example electronic locking codings, which supplement the mechanical lock codings of the key to increase the security of locking.

In the door lock known from EP-A-200,912 the profiled cylinder is held in the insertion of the lock housing by a flange screw which can be screwed into an aperture on its flange. In order not to have to produce and release the electric connection between the reading device of the profiled cylinder and the electronic circuit of the lock housing separately in installation and removal of the profiled cylinder, the contact elements on the lock housing side are arranged on a clamping strap displaceable transversely of the flange of the profiled cylinder, which strap grasps round the flange and can be displaced in the manner of a spindle drive by the flange screw transversely of the flange of the profiled cylinder. The contact elements of the clamping strap which are to be brought into engagement with counter-contact elements on the profiled cylinder are provided on the side of the clamping strap remote from the flange screw together with an additional centring bolt fitted fast on the clamping strap. For the fixing of the profiled cylinder in the insertion opening of the lock housing the flange screw is screwed towards the profiled cylinder, the centering bolt and the contact elements likewise being brought closer to the profiled cylinder by the screwing movement.

In the known door lock the profiled cylinder is fixed exclusively by the flange screw and the centring bolt provided oppositely on the clamping strap. Since the insertion opening of the lock housing surrounds the profiled cylinder with a tolerance interval, which permits tilting movements of the profiled cylinder, in the known lock faults of alignment can occur between the electric contact elements of the clamping strap and the associated counter-contact elements of the profiled cylinder. Especially in the case of a relatively large number of contact elements to be connected thus the installation of the profiled cylinder can be made difficult or even impossible. Furthermore the danger exists that in the clamping of the profiled cylinder non-aligned contact elements may be damaged.

SUMMARY OF THE INVENTION

The problem underlying the invention is to improve the centering the profiled cylinder in relation to electric contact elements which close automatically in the fixing of the profiled cylinder in the lock housing.

In a lock according to the invention, the contact elements to be brought into engagement with counter-contact elements of the profiled cylinder and at least one detent element to be brought into engagement with a counter-detent element of the profiled cylinder are arranged movably on a slide piece displaceable by means of a setting means and transversely of the profiled cylinder in a way that in the fastening of the profiled cylinder in the lock housing firstly the detent element centers and fixes the profiled cylinder at least in transverse relationship to the direction of slide of the contact elements, before the contact elements come into engagement with the counter-contact elements allocated to them. Faults of alignment of the contact elements are thus avoided.

In a first embodiment of the invention, this is achieved simply by arranging the contact elements and the detent element at the slide piece in movable relationship to each other.

In the lock known from EP-A-200,912 the profiled cylinder is clamped in between two points which permit a tilting movement of the profiled cylinder about their axes to the extent of the dimensional tolerances of the insertion opening of the lock housing. This tilting tolerance increases the faults of alignment of the contact elements. In a preferred embodiment the lock housing contains a pedestal in which the flange of the profiled cylinder is guided with close fit. The slide piece in turn is guided displaceably on the pedestal, whereby the tolerances between the contact elements of the side piece and the counter-contact elements of the profiled cylinder can be considerably reduced The pedestal can if desired be adjustably connected with the lock housing, in order that faults of alignment of the profiled cylinder for example in relation to door fittings or the like can be compensated, without this having any influence upon the tolerances of the contact elements.

For the guidance of the slide piece on the pedestal mutually associated slide faces can be formed on these parts. The constructive expense is particularly low when the slide piece is guided at at least one of the guide bolts extending from the pedestal. For security against twisting, the slide piece guided on the guide bolt can be guided on the walls of the lock housing. Since this measure in the individual case increases the tolerances, several mutually parallel guide bolts can be provided An accurately fitting, twist-proof guidance can especially simply be achieved if the detent element is formed as detent bolt and is also used at the same time to secure the slide piece against twisting.

It would be possible to think of bringing the detent element and the contact elements of the slide piece into engagement with the profiled cylinder by means of separate setting elements to be operated in succession. Only one single operating element suffices, if the detent bolt forming the detent element is displaceably guided on the slide piece and is initially stressed by a spring towards a detent opening associated with the profiled cylinder. The spring determines the engagement loading with which the detent bolt initially fixes the profiled cylinder, while the slide piece and the contact elements preferably stationarily retained thereon are subsequently moved towards the profiled cylinder. An improvement of this design is achieved if the slide piece does not have to grasp round the profiled cylinder.

The stress force exerted by the spring upon the detent bolt can in the individual case be too small finally to fix the profiled cylinder operationally fast in the lock housing. In a further development one of the stops of the slide piece ensures that the detent bolt engages immovably in the detent opening cf the profiled cylinder, so that the latter can no longer be pulled out of the insert opening of the lock housing. When a pack of dished springs is used as the spring, the pack compressed to its block length can be utilised as an end stop.

The detent bolt is expediently guided in the slide piece rotatably about its axis. This has especially the advantage that in the final phase of the feed motion of the slide piece no torque can be transmitted from the slide piece to the profiled cylinder which could give rise to a tilting movement of the profiled cylinder and accordingly to a fault of alignment of the contact elements.

To further improve the centering, a centring pin lying opposite to the detent bolt is provided and ensures a precentering in the insertion of the profiled cylinder, even before the detent bolt provided on the slide piece acts on the profiled cylinder.

Another configuration of the invention makes use of the last-mentioned improvement, wherein at the slide piece at least two detent elements, which are arranged at a distance from one another and which are designed as detent bolts,.are held fixedly in the direction of slide, and to which are assigned detent openings at the profiled cylinder in a way that the detent bolts engage in the detent openings when the profiled cylinder is fixed at the lock housing, the engagement taking place before the contact elements come into contact with the counter-contact elements. The detent bolts provide a precentering of the slide piece and of the profiled cylinder transversely to the direction of insertion of the contact elements. An abutment face of the slide piece allows the actual fixing of the profiled cylinder in the insertion opening of the lock housing. When clamped against the profiled cylinder by the setting means, the abutment face of the slide piece is adjacent to the profiled cylinder, for example its flange, and clamps the profiled cylinder in the insertion opening of the lock housing.

The detent bolts engaging in the detent openings of the profiled cylinder secure the profiled cylinder clamped by the slide piece against being pushed out of the insertion opening. The slide piece carries at least one guide arm, preferably however, in order to secure against twisting, two guide arms. At the side of the slide piece facing away from the profiled cylinder, these guide arms are movably guided in guide openings of a pedestal mounted at the lock housing. In this manner, not only very exact guidance of the slide piece at the lock housing can be achieved, but also a particularly stable fixing of the profiled cylinder against its being pushed out of the lock housing is provided. The guide arms can, for example, be designed as extensions of the detent bolts, or they may be end pieces being an integral part with the slide piece.

In order to be able to compensate feed motion tolerances of the slide piece, the contact elements and the counter-contact elements are preferably plug-in contacts. Contacts of this kind ordinarily consist of a pin part and a socket part radially resiliently abutting on the pin part. While the socket part normally is relatively insensitive, pins can be bent or soiled in the case of inexpert handling. In a preferred embodiment, therefore, the pin parts are housed in a protected manner within the profiled cylinder. It is self-evident that the pin parts do not protrude from the profiled cylinder in order that the cylinder may be inserted into the lock housing.

The drive of the slide piece can take place by means of eccentrics, levers or the like. For the sake of simplicity, a spindle drive is provided the threaded spindle of which can be formed, for example in the case of a mortise door lock, by a flange screw fixed axially to the flange rail of the lock. However, the flange screw does not penetrate the flange of the profiled cylinder, as usual, but ends at a distance thereof.

The invention is suitable especially for use in a door lock driven by an electric motor, as proposed in German Patent Application P 37 42 153.0, which is not an earlier publication. In this door lock the bolt is pushed in and out by an electric motor. The electric motor is coupled for both directions of movement of the bolt through a gearing with an engaging device which, when the bolt is drawn back, also draws back the catch of the door lock Moreover the catch can be retracted, independently of the drive by the electric motor, manually by means of a handle nut, since an overload clutch formed as detent clutch is arranged in the torque transmission path of the gearing. The detent clutch proposed in the said patent application is formed as a pawl clutch with a pivotably mounted, spring-loaded pawl. The construction expense of the proposed detent clutch is admittedly comparatively high, since a plurality of individual parts must be riveted with one another and assembled. Under another aspect of the invention, which is of importance too in other locks than the lock as explained above, it is further the problem of the invention to simplify the overload clutch of a door lock of the kind as proposed in Patent Application P 37 42 153.0, where the tripping torque of the overload clutch is to be precisely predeterminable.

This further problem is solved by the invention. The slider carrying the detent projection can be fitted without problem. Certain The configurations according to the invention have furthermore the advantage of especially compact construction style, and facilitate the integration of the overload clutch into the gearing.

Compared with conventional mechanically or manually blockable locks, the door lock driven by electric motor as proposed in Patent Application P 37 42 153.0 contains a plurality of additional components, so that a narrow style of construction of the components is of special importance. In the case of the door lock as proposed in Patent Application P 37 42 153.0 the rotation movement of the electric motor is converted by a rack toothing into a translational movement The rack toothing is not provided directly on the bolt, but on a control part translationally displaceably guided on the lock housing transversely of the bolt movement The control part is coupled with the bolt through oblique thrust faces for both directions of movement of the bolt, and can be moved out beyond the position allocated to the retracted end position of the bolt, in order through the engaging stop to entrain the catch in the inward direction. For the inward movement of the catch the control part displaced merely translationally during the thrust movement of the bolt is deflected into a pivoting movement which drives the catch directly in the inward direction. The rack toothing extends, for the movement section retracting the catch, transversely of the section effecting the bolt movement.

In order to reduce the construction space for the gear, under a further aspect of the invention the rack toothing sections for the bolt movement and the catch movement are so arranged that they merge into one another in a concave toothing section By this simple measure it is possible to increase the step-down ratio of the gearing, whereby a greater force is available for the controlling of the catch.

In the door lock as proposed in German Patent Application P 37 42 153 both the catch and the handle nut are held in the respective rest positions by a leg spring. However the supporting of such leg springs requires comparatively great construction space in the lock housing, which space can be reduced according to claim 20. The outward thrust spring of the catch is accommodated in a guide opening provided in any case, in its catch tail, and is formed for example as helical compression spring The handle nut is held in the rest position by a spiral torsion spring arranged concentrically with it, the torsion spring likewise being able to be accommodated within the construction space provided in any case for the handle nut. The space required hitherto for the leg springs can be used for the electronic equipment which is to be accommodated in the lock housing.

The various features of novelty which characterize the invention are pointed out with particularity in the claims annexed to, and forming a part of this disclosure. For a better understanding of the intention, its operating advantages and specific objects attained by its use, reference should be had to the accompanying drawings and descriptive matter in which there are illustrated and described preferred embodiments of the invention.

BRIEF DESCRIPTION OF THE PREFERRED EMBODIMENTS

Figure 1:
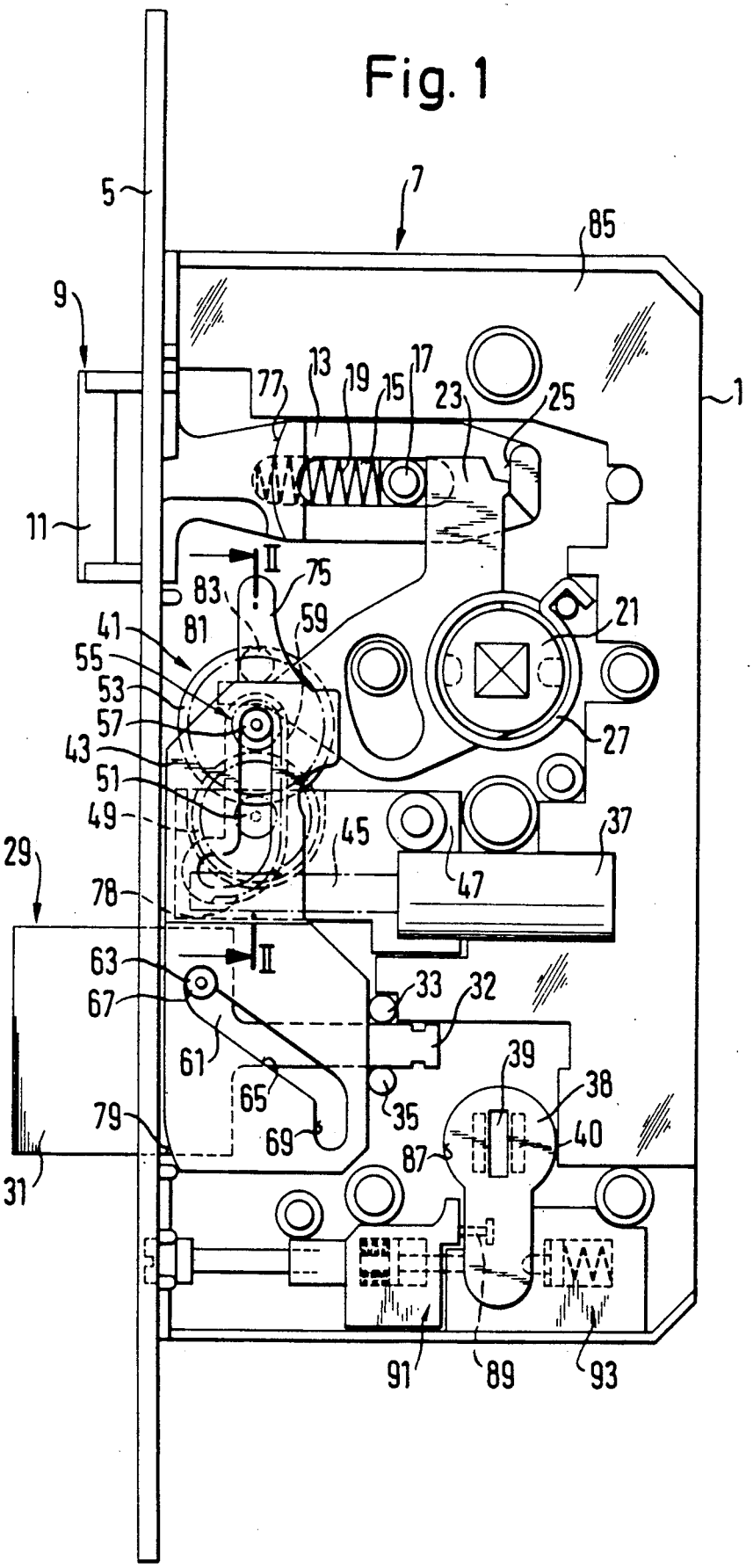
FIG. 1 shows a lateral elevation of a mortise door lock, driven by an electric motor, with pushed-out bolt and pushed-out catch, one side wall being removed for the sake of clarity.
Figure 2:
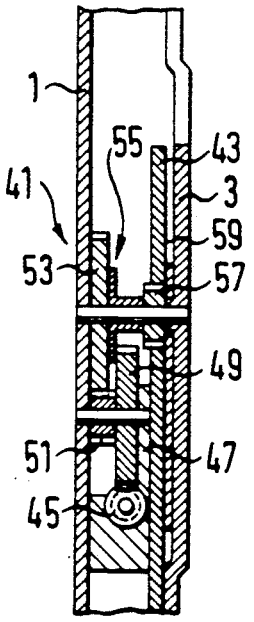
FIG. 2 shows a partial sectional view through the door lock, seen along a line II—II in FIG. 1.

FIGS. 1 and 2 show a mortise door lock with a lock housing 7 defined by side wall plates 1, 3 and a flange rail 5 arranged on a narrow side. In the lock housing 7 a catch 9 is guided displaceably at right angles to the flange rail 5, the head 11 of which catch emerges through an opening (not shown further) of the flange rail 5 and the tail 13 of which catch is guided on a journal 17 fast with the housing and engaging in a slot 15 of the tail 13. In the slot 15 a helical compression spring 19 is housed which bears for the one part on the journal 17 and for the other part on the end of the slot 15 on the catch head side, and initially stresses the catch 9 in the outward direction. The catch 9 can be retracted against the helical compression spring 19 by means of a handle nut 21 pivotably mounted in the lock housing 7 and by means of a handle (not further illustrated) arranged on the inner side of the door. For this purpose the handle nut 21 has a finger 23 which entrains the catch 9 in the inward direction through a shoulder 25 of the catch tail 13. A return spring 27 formed as spiral torsion spring holds the handle nut 21 in a rest position liberating the catch 9. The return spring 27 coaxially surrounds the handle nut 21 and hardly requires more space than the handle nut 21 itself. The lock housing 7 thus offers space for additional electronic components.

In the lock housing 7 at a distance from the catch 9 a bolt 29 is guided for displacement at right angles to the flange rail 5, which bolt passes with its bolt head 31 through an opening (not further illustrated) of the flange rail 5 and is guided with its bolt tail 32 within the lock housing between two journals 33, 35 fast with the housing, The bolt 29 is retracted and extended by an electric motor 37 which also retracts the catch 9 independently of the handle actuation. The electric motor 37 is controlled by a control circuit (not further illustrated) such as is described by way of example in DE-A-36 06 620. The control system here responds to an electronically coded key (not further illustrated) and for this purpose is connected with a reading device 40 arranged in a profiled cylinder 38 of the door lock, which device reads the information of the key inserted into a key passage 39 of the profiled cylinder and accordingly delivers electric signals.

The electric motor 37, through a toothed-wheel gearing 41, drives a control part 43 of plate form which is linearly displaceably guided at right angles to the direction of movement of both the catch 9 and the bolt 29, between the inner side of the flange rail 5 and the Journals 33, 35. The gearing 41 arranged between the catch 9 and the bolt 29 comprises a worm 45 seated on the drive-output shaft of the electric motor 37, which worm meshes with a worm wheel 49 mounted in the side wall plate 1 for the one part and a bearing plate 47 fast with the housing for the other part. Through a coaxially arranged pinion 51 the worm wheel 49 drives a toothed wheel 53 which is coupled with a pinion through an overload clutch 55, which is explained in greater detail below and transmits only a predetermined torque, with a pinion 57. The pinion 57 engages in a rack toothing 59 extending parallel to the flange rail 5, that is parallel to the direction of displacement of the control part 43, and driving the control part 43. The displacement movement of the control part 43, extending at right angles to the direction of movement of the bolt 29, is transmitted to the bolt 29 by way of a slot 61 extending obliquely of both directions of movement in the control part, in which slot there engages a pin 63 fitted on the bolt 29.

Figure 3:
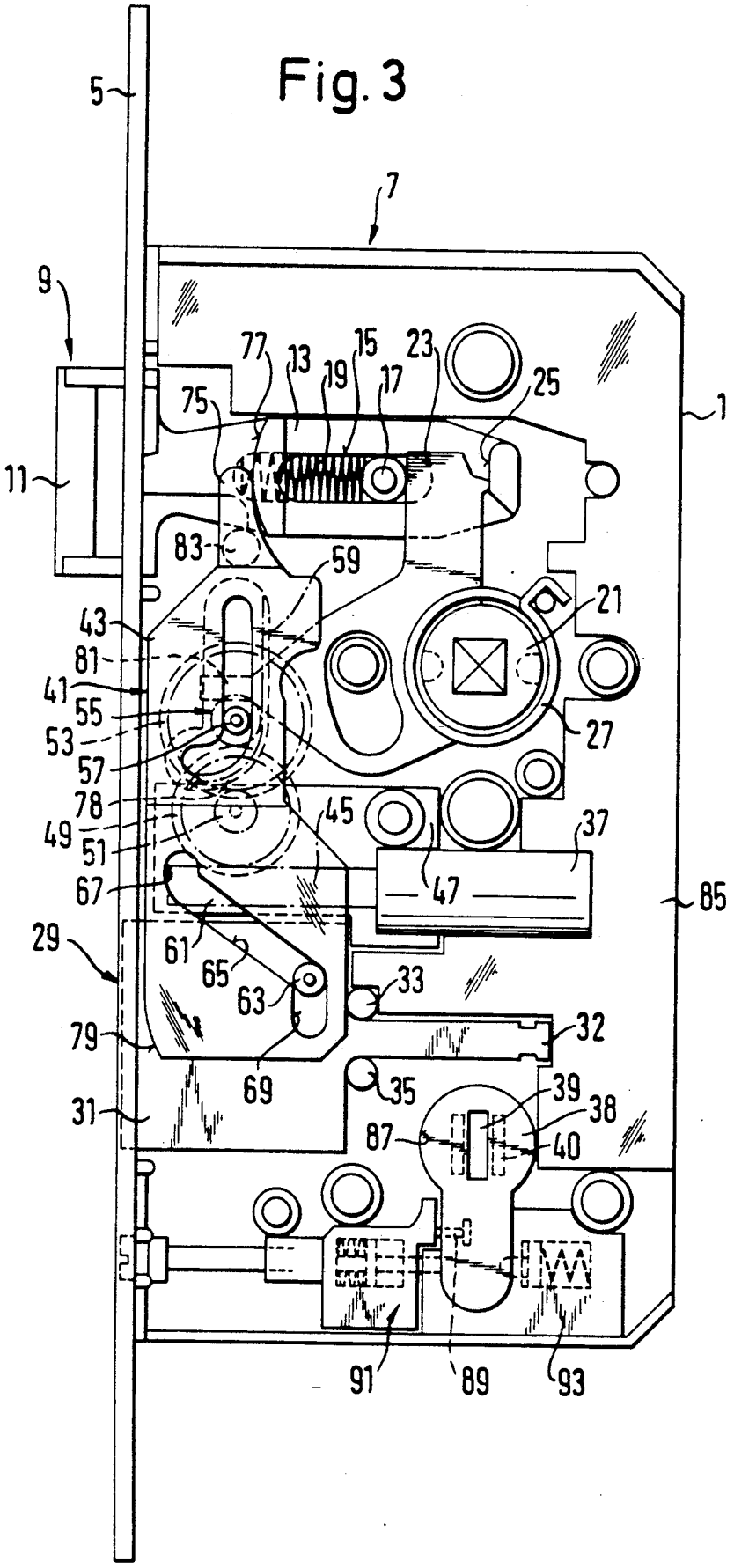
FIG. 3 shows a lateral elevation of the door lock according to FIG. 1, with the bolt retracted and the catch pushed out.

FIG. 1 shows the door lock in the blocked condition, that is with the bolt 29 pushed completely out of the lock housing 7, the control part 43 being set into its position remote from the catch 9. FIG. 3 shows the door lock with the bolt 29 retracted but the catch 9 pushed out, where the electric motor 37 has brought the control part 43 closer to the catch 9, retracting the bolt 29. As FIGS. 1 and 3 show, the slot 61 controlling the movement of the bolt 29 has a substantially Z-shape, the ends of a middle section 65 of the slot 61 extending obliquely in relation both to the direction of movement of the bolt 29 and to the direction of movement of the control part 43 adjoining end sections 67, 69 extending perpendicularly of the direction of movement of the bolt 29. In the completely pushed-out or completely pushed-in position of the bolt 29 the end sections 67, 69 receive the pin 63 and thus secure violent pushing in or pulling out of the bolt 29.

Figure 4:
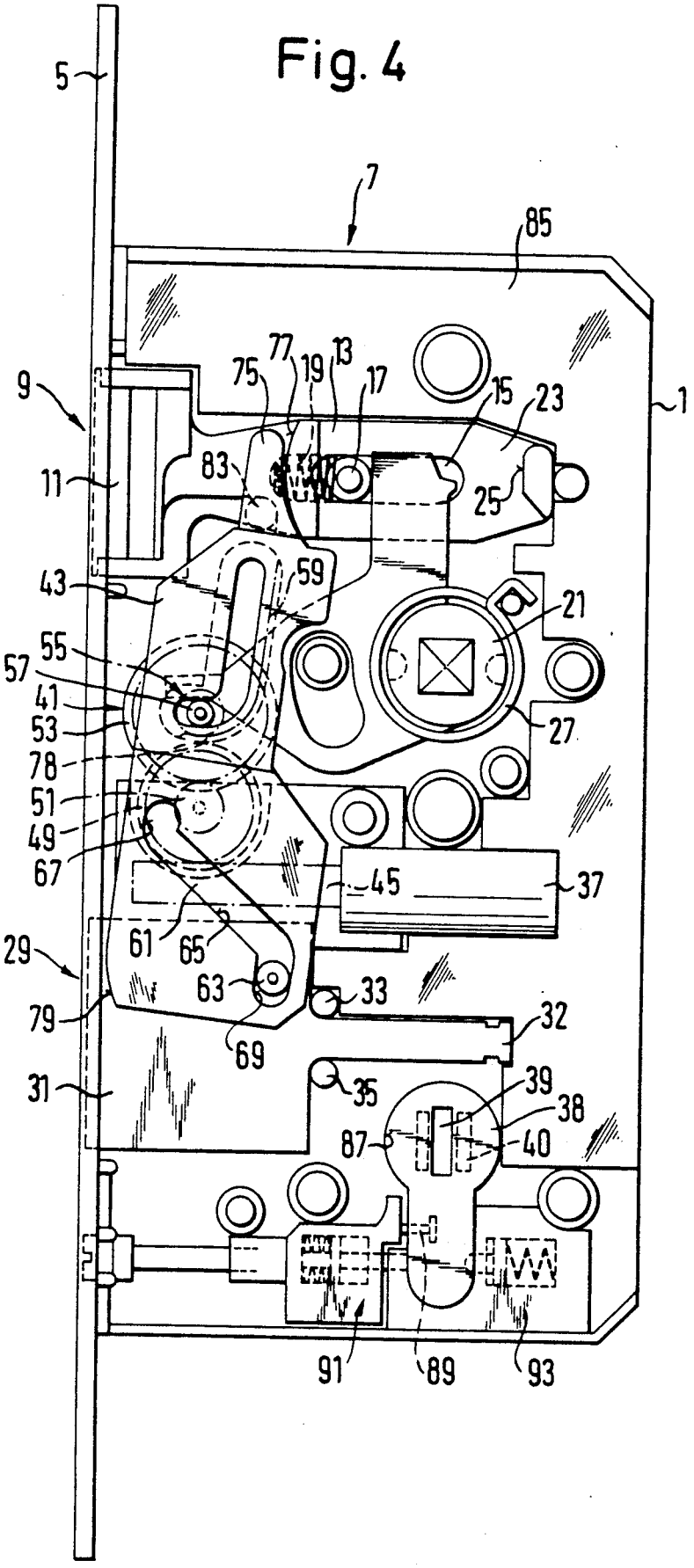
FIG. 4 shows a lateral elevation of the door lock according to FIG. 1 with bolt retracted and catch withdrawn by motor.

The control part 43 also controls the intake movement of the catch 9. The control part 43 carries, adjacent to the catch 9, a finger 75 when the bolt 29 is retracted, drives into an aperture of the catch tail 13 which is limited by a shoulder 77. The rack toothing 59 extends out over the rectilinear region parallel to the flange rail 5, necessary for the bolt movement, and is curved over a concave toothing region 78 towards a toothing region in which the pin 63 of the bolt head 31 enters the end section 69 of the slot 61, towards the flange rail 5, so that the pinion 57 meshing with the rack toothing 59 pivots the control part 43 in the clockwise direction in the Figures about the pin 63. As FIG. 4 shows, in this action the finger 75 entrains the catch 9 in the retraction direction. FIG. 4 shows the door lock with the bolt 29 retracted by electric motor and the catch 9 retracted by electric motor. In order to render the pivoting movement of the control part 43 possible, the journals 33, 35 guiding the bolt tail 32 are so arranged that the control part 43 can tilt for the pivoting movement between the journals 33, 63. The corner adjacent to the flange rail is provided with a flattened portion 79. Since the rack toothing 59 extends in the arc region on the concave side, that is the outer side, compared with the inner side an increased step-down ratio results, which reduces the space requirement of the gearing 41.

Figure 5:
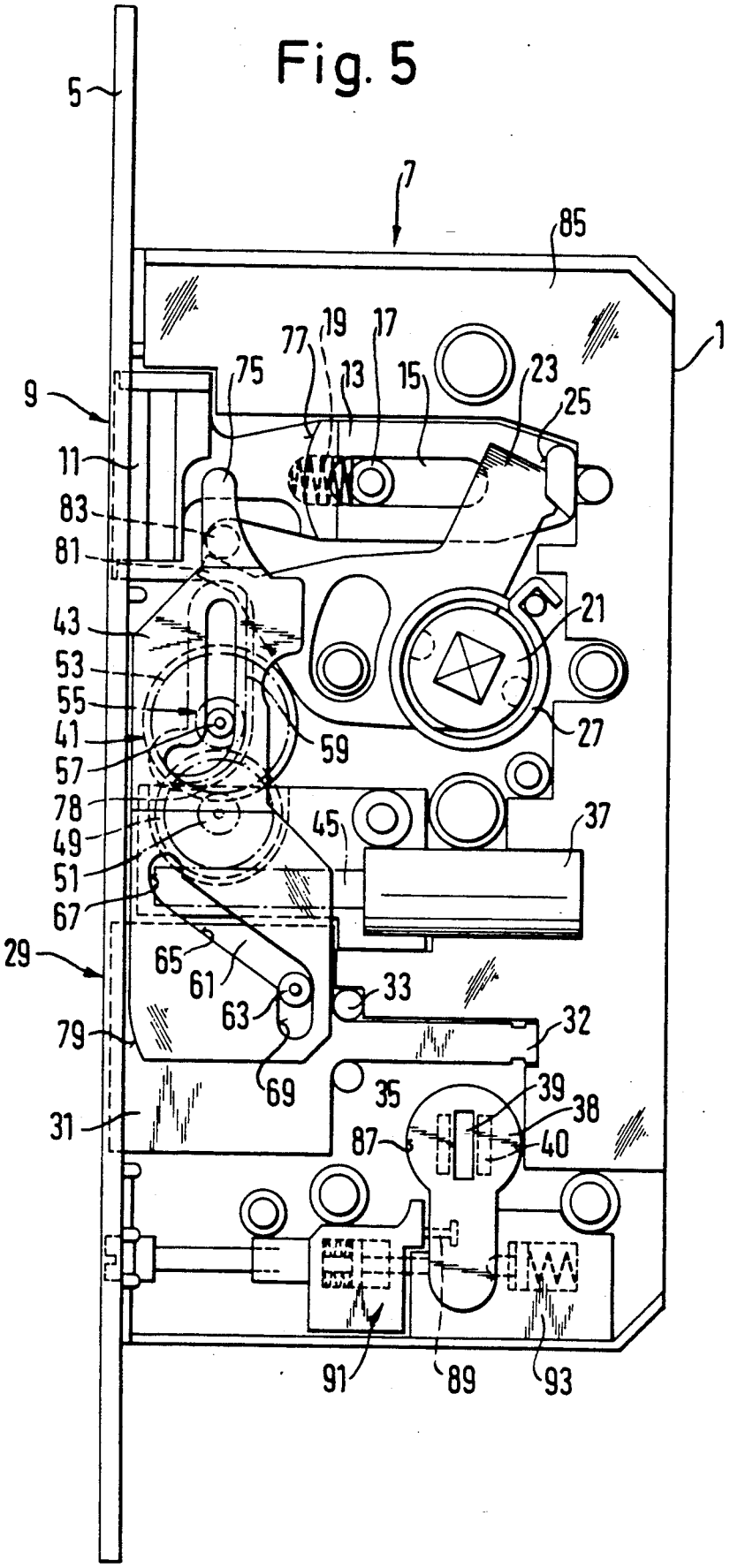
FIG. 5 shows a lateral elevation of the door lock according to FIG. 1 in the case of manual opening.

The door lock can if necessary also be opened by actuation of the door handle, independently of the electric motor drive, even if the bolt 29 is pushed out (panic function). As FIG. 5 shows, by rotation of the handle arranged on the inner side of the door, that is the secured side of the door, the handle nut is pivoted, whereby the finger 23 draws in the catch 9 by means of the shoulder 25 provided on the catch tail 13. At the same time a projection 81 formed on the handle nut 21 entrains the control part 43 in the opening direction of the bolt 29. The projection 81 in this movement strikes upon a projection 83 of the control part 43, for example a riveted-on pin of the control part 43. The enforced movement of the control part 43 is transmitted through the oblique faces of the slot 61 and the pin 63 to the bolt 29 which is thereby shifted into its retracted position. The overload clutch 55 arranged in the drive path of the gearing 41 between the electric motor 37 and the control part 43 is overcome in the manual actuation of the control part 43 and uncouples the inherently self-locking worm 45 The overload clutch 55 furthermore protects the electric motor 37 and the gearing 43 against overloading, in the case of electric motor drive of the door lock Details of the overload clutch will be explained below with reference to FIGS. 7 to 10.

Figure 6:
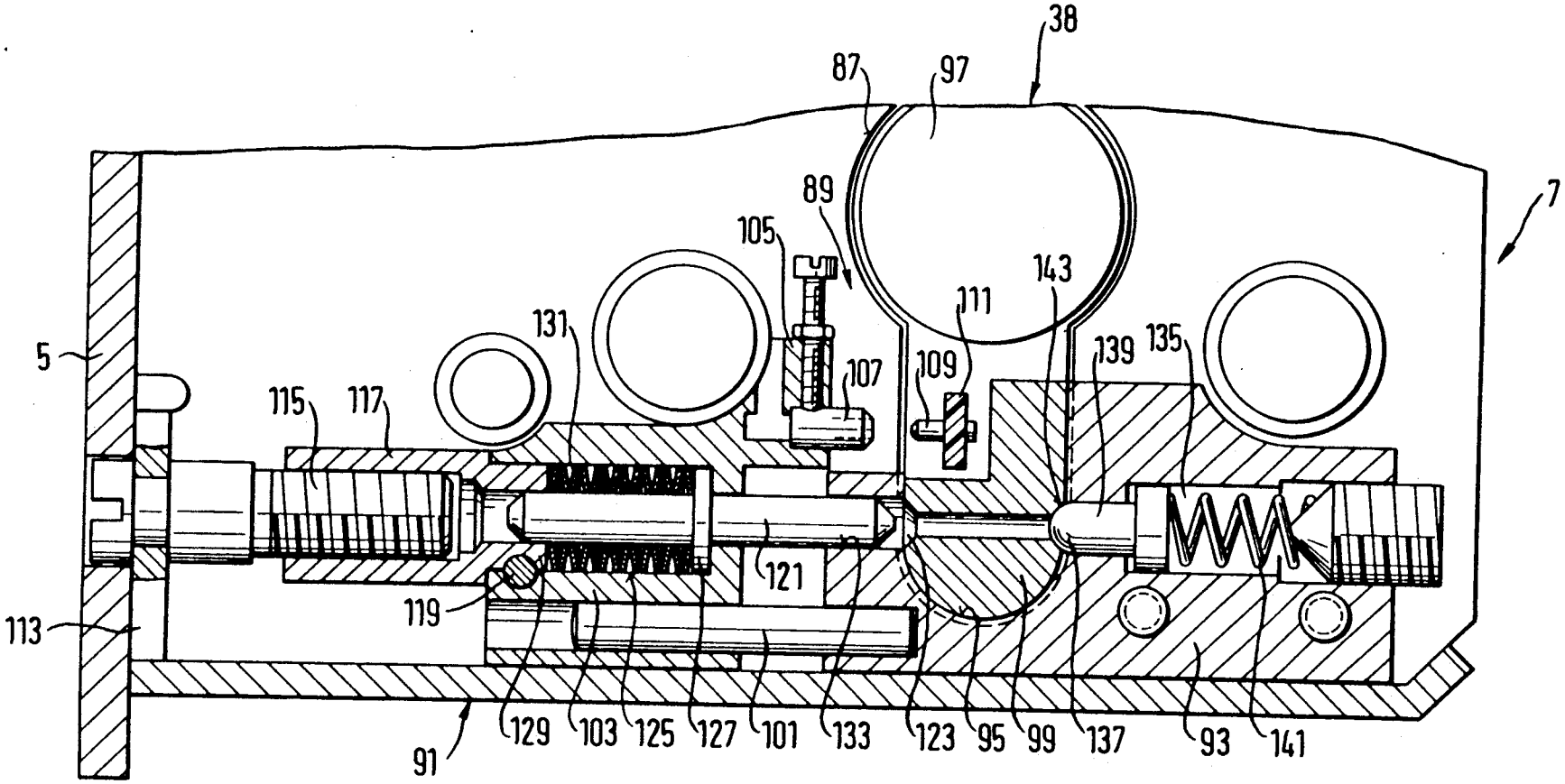
FIG. 6 shows a detail section through the region of a profiled cylinder of the door lock according to FIG. 1 and its securing elements.

The electric motor 37 is controlled by an electronic circuit (not shown further) which is accommodated on a circuit plate 85 arranged laterally of the mechanical components of the door lock, between the side walls 1, 3 of the lock housing 7. The electronic circuit is connected with the reading device 40 of the profiled cylinder 38 through several leads, for example six The profiled cylinder 38 seated in a matchingly formed insertion opening 87 of the two side parts 1, 3 is connected to the electronic circuit by way of a plug-in connection 89 in these supply leads. FIG. 6 shows details of the plug-in connection 89 and a pertinent retaining device 91 which holds the profiled cylinder 38 removably in the insertion opening 87. In contrast with FIGS. 1 to 5 however the retaining device 91 is shown in a position which permits the withdrawal of the profiled cylinder 38 The retaining device 91 has a pedestal 93 held on the lock housing 7 with an aperture 95 aligned with the insertion opening 87, in which aperture the flange 99 protruding from the cylinder part 97 of the profiled cylinder engages The aperture 95 surrounds the flange 99 both laterally and along its longitudinal edge remote from the cylinder part 97, and ensures that the profiled cylinder 38 is centered in relation to the pedestal 93 and not by edges of the insertion opening 87 enclosing the profiled cylinder with slight over-dimensioning. On a guide pin 101 held in the pedestal 93 a slide piece 103 is displaceably guided which carries, on a bracket 105, a strip with a plurality of connector sockets 107 of the plug-in connection 89 which are distributed along the profiled cylinder 38. The matching connection elements of the plugin connection 89 are arranged as connector pins 109 completely within an aperture of the flange 99 of the profiled cylinder 38 on a plug strip 11. Thus the flange 99 protects the delicate connector pins 109 against damage and soiling.

The slide piece 103 is displaceable along the guide Journal 101 by means of a threaded spindle 115 held rotatably but axially fixedly on the flange rail 5 by an abutment 113, the threaded journal 115 being screwed into a threaded bush 117 which is secured with a securing pin 119 fast in rotation on the slide piece 103. The slide piece 103 carries in addition to the connection sockets 107 a detent pin 121 with which there is associated, on the flange 99 of the profiled cylinder 38 on the side of the connector pins 109, a detent opening 123. The detent bolt 121 is displaceable in the slide piece 103 axially parallel with the guide journal 101 and carries an annular collar 127 in a chamber 125 of the slide piece 103. Between the annular collar 127 and an extension piece 129, engaging in the chamber, of the threaded bush 117 there is clamped a dished spring pack 131, which initially stresses the detent bolt 121 towards the detent opening 123. The end of the detent journal 121 adjacent to the detent opening 123 is guided in a guide opening 133 of the pedestal 93

The guide journal 101 and the detent journal 121 guide the slide piece 103 securely against rotation and in centered manner in relation .to the pedestal Since the distance between the detent opening 123 and the adjacent end of the detent journal 121, in the position of the slide piece 103 freeing the profiled cylinder 38, is less than the distance between the connector sockets 107 and the connector pins 109, the detent journal 121 on the profiled cylinder 38 snaps into engagement before the plug-in connection 89 is closed. The detent journal 121 thus locks the profiled cylinder 38 in a position orienting the connector sockets 107 and connector pins 109 in alignment with one another, before the contact is closed. Thus damage to the sockets 107 and pins 109 by reason of defects of alignment is avoided.

The detent power of the detent Journal 121 is initially determined by the initial stress of the dished spring pack 131. In the individual case the initial stress can be too slight to secure the profiled cylinder 38 operationally against extraction. In order to achieve this the blocking length of the dished spring pack 131, when completely compressed, is so selected that the detent Journal 121 in the end position of the slide piece 103 engages nondisplaceably in the detent opening 123 and is supported, through the completely compressed dished spring pack 131, on the extension piece 129 of the threaded sleeve 117. When the slide piece 103 is in the end position the plug-in connection 89 is closed, the length of the plug-in pins 109 being so dimensioned that they can compensate for movement tolerances of the sockets On the side opposite to the detent journal 121 in a bore 135, coaxial with the detent journal 121, of the pedestal 93, there is displaceably guided a centering pin 139 to be provided with a spherical tip 137, which pin is initially stressed by a compression spring 141 into a detent opening 143 of the flange 99. The profiled cylinder 38 can be inserted, the compression spring 141 being overcome, into the aperture 95 of the pedestal 93, the centring pin 139 ensuring a pre-centering of the profiled cylinder 38 in relation to the pedestal 93 and thus a pre-centring of the detent opening 123 in relation to the detent journal 121.

FIGS. 7 to 10 show details of the overload clutch 55 explained with reference to FIGS. 1 to 5.

The overload clutch 55 is formed as detent clutch and couples the toothed wheel 53 with the pinion 57, which is rotatable on a common spindle 145 in relation to the toothed wheel 53. A slider 149 having a detent projection 151 protruding radially to the spindle 145 and cranked axially towards the pinion 57 is seated on the side of the toothed wheel 53 facing the pinion 57, being guided displaceably radially of the spindle 145 in an aperture 147 enclosing the spindle 145. The detent projection 151 overlaps with the circumference of a circular disc 153 which is connected through journals 154 fast in rotation with the pinion 57 and axially fixes the slider 149 in the aperture 147. The circular disc 153 has on its circumference a detent aperture 155, in which the detent projection 151 of the slider 149 engages under initial stress from a spring 157. The projection 151 and the aperture 155 have oblique marginal edges, seen in the circumferential direction, so that the projection 151 coupling the toothed wheel 53 with the pinion 57 is lifted, if a predetermined torque is exceeded, out of the aperture 155 against the force of the spring 157, and releases the overload clutch FIGS. 7 and 8 show the overload clutch in engagement, while the released condition is represented in FIGS. 9 and 10.

Figure 7:
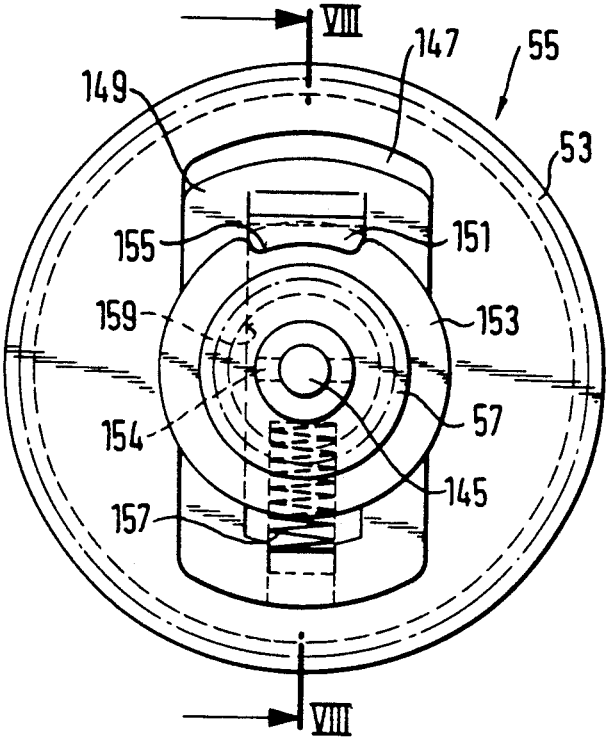
FIG. 7 shows a lateral elevation of an overload clutch of the door lock according to FIG. 1 in the engaged condition.
Figure 8:
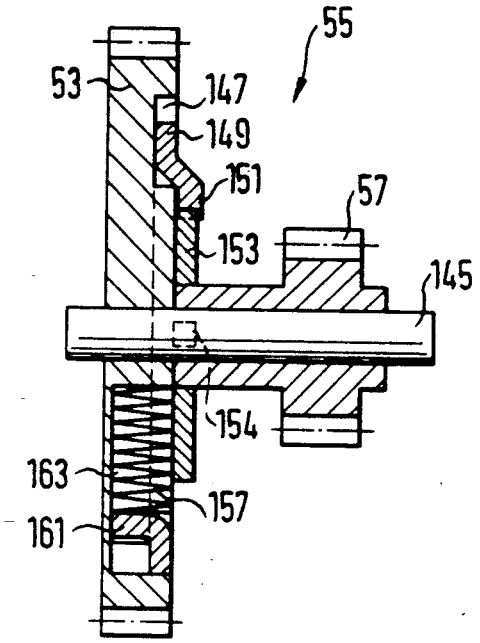
FIG. 8 shows a sectional view through the overload clutch, seen along a line VIII—VIII in FIG. 7.
Figure 9:
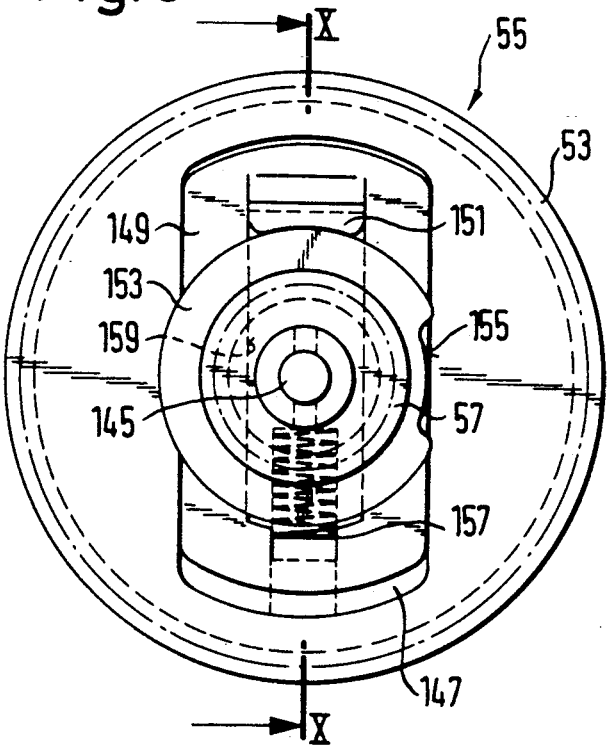
FIG. 9 shows a lateral view of the overload clutch according to FIG. 7 in the disengaged condition.
Figure 10:
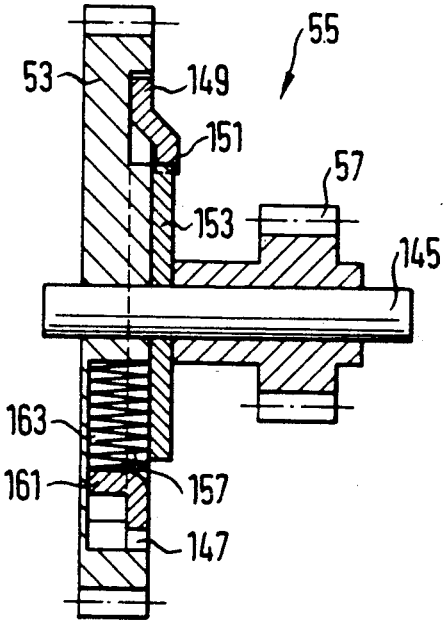
FIG. 10 shows a sectional view through the overload clutch, seen along a line X—X in FIG. 9.
Figure 11:
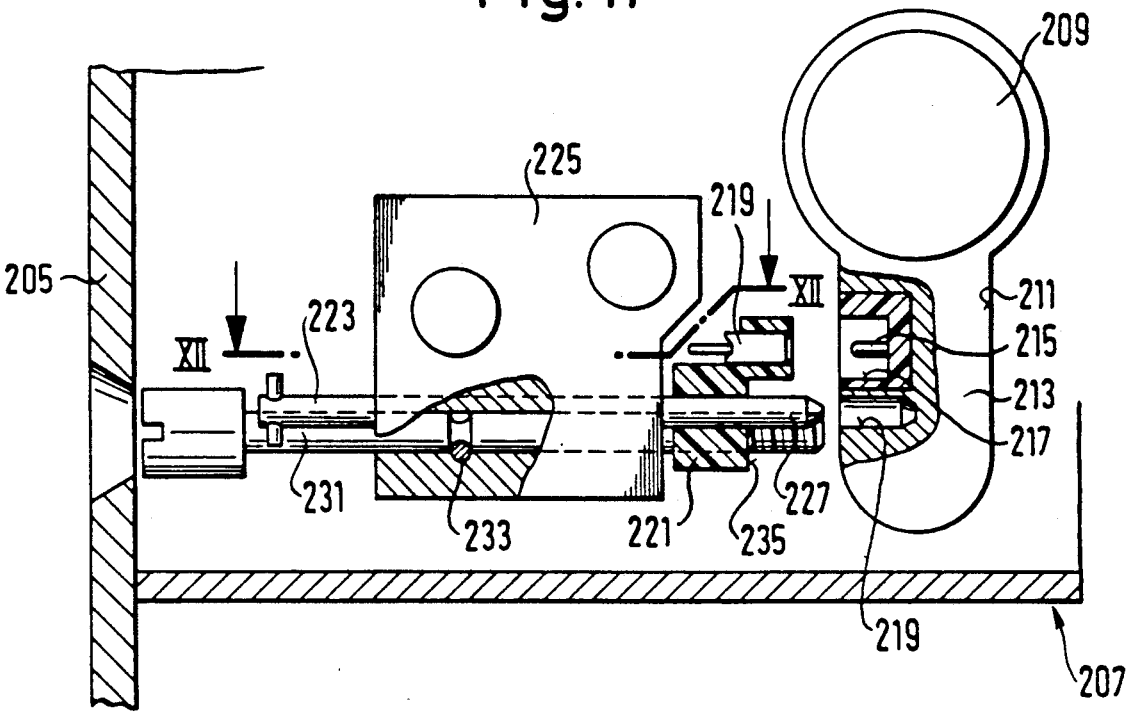
FIG. 11 shows a detail section through the area of a profile cylinder and its mounting elements in a variant of the door lock according to FIG. 1, seen along a line XI—XI in FIG 12.
Figure 12:
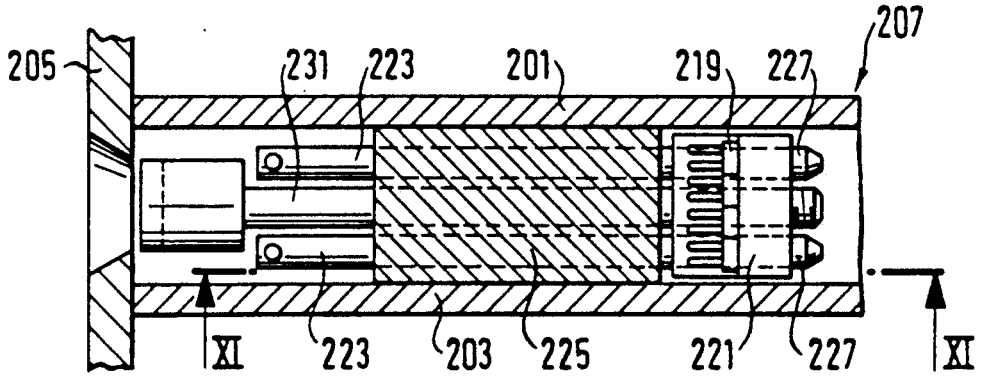
FIG. 12 shows a sectional view seen along a line XII—XII in FIG. 11.

As further shown by FIGS. 7 and 9, the slider 149 has a slot 159 through which the spindle 145 passes. The projection 151 is bent out of the interior of the slot to the pinion 57, while radially oppositely to the projection 151 a tab 161 is bent into a radially extending chamber 163 of the toothed wheel 53. The chamber 163 contains the spring 157, which is supported between the tab 161 and an end wall, adjacent to the spindle 145, of the chamber 163. The overload clutch 55 is comparatively simple to fit and requires only a few parts.

FIGS. II and 12 show a variant of a profiled cylinder fastening which can be used instead of the profiled cylinder fastening of FIG. 6 in a door lock according to FIG. 1 The door lock includes again a lock housing 207 designed of side walls 201, 203 as well as a flange rail 205. The lock housing 207 comprises in its side walls 201, 203 for receiving a profiled cylinder 209, provided with an electronic reading device, insertion openings 211 having a form complementary with the profile form of the profiled cylinder 209. For the connection of a reading device, not shown in detail, and the assigned drive elements of the lock there are housed at a flange 213 extending along the profiled cylinder and protruding transversely from this flange 213, mechanically protected and electrically insulated, several connector pins 215 in an impression 217 of the flange 213. Connector bushes 219 are assigned to the connector pins 215, which connector bushes, in turn, are isolated and kept at a slide piece 221 which is slideable in direction of insertion of the connector pins 215. The slide piece 221 is mounted at two bolts 223 which extend in parallel relationship and at a distance from each other in the direction of insertion of the connector pins 215, and which are slideably guided at the side of the slide piece 221 facing away from the profiled cylinder 209 in a pedestal 225 fixed at the lock housing 207. The bolts 223 penetrate the slide piece 22 and protrude from the bushes 219 at the side facing the profiled cylinder in the direction of slide of the slide piece 221. The portions protruding from the slide piece 221 in the direction of the profiled cylinder 209 form detent bolts 227 which are assigned detent holes 229 in the flange 213 of the profiled cylinder. The detent bolts 227 engage in the detent holes 229 and align the flange 213 relative to the slide piece 221 before the connector pins 215 enter the bushes 219. In this way damage to the connector contacts is avoided in spite of the normally minor play of the profiled cylinder 209 in the insertion openings 211. Since they are guided along a considerable length in the pedestal 225, the bolts 223 securely avoid that the profiled cylinder 209 is pulled out by force. In order to readjust the slide piece 221, a setting screw 231 is provided in the pedestal 225. The setting screw 231 is rotatable but axially fixed by means of a securing pin 233 and can be reached from the flange rail 205. The setting screw 231 grasps, in the way of a spindle drive, into a threaded opening of the slide piece 221. The slide piece 221 can be slid by means of the setting screw 231 from the flange rail 205 against the flange 213 of the profiled cylinder. An abutment face 235 provided at the slide piece 221 clamps the profiled cylinder against the edges of the insertion openings 211. The retention force need not be particularly great, however, because the profiled cylinder 209 is secured against being pulled from the insertion openings 211 by the bolts 223.

In an expedient variant, not shown in detail, of the previously explained profiled cylinder fastening, instead of the bolts 223, long guiding end pieces forming an integral part of the slide piece 221 are arranged at the side of the slide piece 221 facing away from the detent bolts 227. The guiding end pieces are guided in grooves of the pedestal 225 and enclose the pedestal between them in the way of a fork.

While specific embodiments of the invention have been shown and described in detail to illustrate the application of the inventive principles, it will be understood that the invention may be embodied otherwise without departing from such principles.

What we claim is:

1. A lock, comprising:

a lock housing (7; 207), a profiled cylinder (38: 209) having a cylinder axis is insertable into an insertion opening (87: 211) of the lock housing (7: 207) and shaped in conformity with the insertion opening (87; 211), said cylinder comprises in a cylinder part (97) an axially extending key passage (39) for the reception of a key and a radially protruding flange (99:213) on the cylinder part (97), a reading device (40) provided on the profiled cylinder (38; 209), which detect control information of the key introduced into the key passage (39) and delivers electric signals corresponding to the control information, a slide piece (103; 221) guided displaceably transversely toward and away from the cylinder axis of the profiled cylinder (38; 209) on the lock housing (7; 207) with a plurality of electrical contact elements (107; 219) with a plurality of electrical contact elements (107; 219) mounted on said slide piece, counter-contact elements (109; 215) mounted on the profiled cylinder (38; 209), arranged to receive said contact elements and at least one detent element (121; 227) on said slide element, with a complementary detent element (123; 229) on the profiled cylinder (38; 209), arranged to receive said detent for fixing said detent in relation to the profiled cylinder (38; 209), and a setting device (115, 117; 231) in engagement with said slide piece by means of which the slide piece (103; 221) is slide piece by means of which the slide piece (103; 221 is movable in relation to the profiled cylinder (38; 209) for the mutual engagement of the detent elements (121, 123; 227, 229) and the contact elements (107, 109; 215, 219), and the contact elements (107; 219) and the detent element (121, 227) are arranged on the slide piece (103; 221) so that the setting device (115, 117; 231), for the fastening of the profiled cylinder (38; 209) on the lock housing (7; 207), moves said slide towards said profiled cylinder whereby firstly the detent element (121; 227) moves into engagement with said complementary detent element (123; 229) for fixing the profiled cylinder (38; 298), and only after such engagement brings the contact elements (107; 219) into contact with the counter-contact elements (109; 215).

2. A lock according to claim 1, wherein the contact elements (107) and the detent element (121) are arranged mutually relatively movable on the slide piece.

3. A lock according to claim 2, wherein on the lock housing (7) a pedestal (93) is held with an aperture (95) guiding the flange (99) of the profiled cylinder (38) laterally and on its longitudinal edge remote from the cylinder part (97), and wherein the slide piece (103) is guided on the pedestal (93).

4. A lock according to claim 3, wherein the detent element of the slide piece (103) is formed as detent bolt (121), to which a detent opening (123) in the profiled cylinder (38) is allocated, and wherein the pedestal (93) comprises a guide opening (133), aligned with the detent opening (123), for the detent bolt (121), through which the 5. A lock according to claim 2, wherein the detent element is formed as a detent bolt (121) guided displaceably for its part on the slide piece (103) in the direction of displacement thereof and initially stressed by a spring (131) towards the profiled cylinder (38), and the complementary detent element with which said bolt is associated comprises a detent opening (123) in the profiled cylinder (38).

6. A lock according to claim 5, wherein the counter-contact elements (109) and the detent opening (123) are provided on one common side of the flange (99) of the profiled cylinder (38), whereby the contact elements (107) are held on the slide piece (103) immovably in relation thereto and with the detent bolt (121) protruding beyond over the contact elements (107).

7. A lock according to claim 5, wherein the detent opening (123) forms a stop limiting the depth of entry of the detent bolt (121) and the detent bolt (121) is displaceable on the slide piece (103) between two end positions limited by stops.

8. A lock according to claim 7, wherein the spring is formed as dished spring pack (131) and one of the end positions is determined by a block length of the dished spring pack (131) when completely compressed.

9. A lock according to claim 5, wherein the detent bolt (121) is guided rotatably about its axis in the slide piece (103).

10. A lock according to claim 5, wherein on a side of the profiled cylinder (38) opposite to the detent bolt (121) a centering pin (139) is guided displaceably axially parallel, and coaxially with the detent bold (121), on the pedestal (93) the centering ping is associated on the profiled cylinder (38) with a centering aperture (143), and the centering pin is stressed by a spring into the centering aperture (143).

11. A lock according to claim 1, wherein at least two detent elements designed as detent bolts (227) are arranged at a distance from one another and are kept on the slide piece (221) fixedly in slide direction, said detent bolts are assigned detent openings (229) at the profiled cylinder (209) in a way that the detent bolts (227) engage in the detent openings (229) when the profiled cylinder (209) is fixed at the lock housing (207), before the contact elements (219) come into contact with the counter-contact elements (215), and the slide piece (221) comprises an abutment face (235) which abuts at the profiled cylinder (209) when the detent bolts (227) engage in the detent openings (229).

12. A lock according to claim 11, wherein a pedestal (225) is mounted at the lock housing (207), the detent bolts (227) penetrate the slide piece (221) and wherein at a side facing away from the profiled cylinder (209) the detent bolts (227) are slideably guided, together with the slide piece (221), in guiding openings of the pedestal (225).

13. A lock according to claim 1, wherein the setting drive is formed as a spindle drive (115, 117) with a threaded spindle (115; 231) guided rotatably but axially fixedly on the lock housing (7; 207), said spindle engages in a threaded opening of the slide piece (103; 221) but ends at a distance from the profiled cylinder (87; 209).

14. A lock in the form of a door lock driven by an electric motor, comprising a lock housing (7), a catch (9) which can be drawn by means of a handle into the lock housing (7) against an outward thrust spring (19), a bolt (29) displaceable between a retracted position and an outwardly thrust position, and a setting drive (37, 41, 34), the setting drive (37, 41, 43) comprises an electric motor (37), a gearing (41, 43) coupling the electric motor (37) with the bolt (29) for both directions of movement and an engaging device (75, 77) for the catch (9) which, on driving of the gearing (41, 43)

in the inward direction of the bolt (29) beyond the retracted position thereof entrains the catch (9) in the inward direction, the setting drive (37, 41, 43) comprises a control part (43) displaceably guided transversely of the direction of movement of the bolt (29) on the lock housing (7), which control part (43) is coupled through a cam gearing (61, 63) with thrust faces extending obliquely in relation to the directions of movement of the bolt (29) and of the control part (43) with the bolt (29) and in its movement allocated to the retraction direction of the bolt (29) is movable, entraining the catch (9), beyond the position allocated to the retracted bolt (29), an overload clutch (55) is arranged in the drive path of the gearing (41, 43) between the electric motor (37) and the control part (43) for limiting the transmittable torque and forming a detent clutch, a handle nut (21) arranged to be actuated by means of a handle carries an engaging stop (81) which through a counterstop (83) on the control part (43) entrains the control part (43) in the bolt retracting direction in the catch withdrawal movement of the handle nut (21), the detent clutch (55) comprises two mutually relatively rotatable, coaxial mutually axially adjacent disc parts (53, 153) of which a first disc part (153) has a circumference, and a second disc part (53) having a slider (149) is radially movably guided and, initially stressed by a spring (157), engages with a detent projection (151) in the detent aperture (155).

15. A lock according to claim 14, wherein the slider (149) is arranged in an aperture (147) on a side of the second disc part (53) axially facing the first disc part (153) and is axially fixed in the aperture (147) by the first disc part (153).

16. A lock according to claim 15, wherein the two disc parts (53, 153) are seated on a common spindle (145), the slider (149) has an opening (159) for passage of the spindle (145) and the spring (157) is arranged on the side of the slider (149) lying diametrically opposite to the detent projection (151).

17. A lock according to claim 16, wherein the spring (157) is arranged in a chamber (163) of the second disc part (53) open to the slider (149).

18. A lock according to claim 14, wherein the second disc part is formed as toothed wheel (53) and the first disc part (153) is connected to a pinion (57) for rotation therewith.

19. A lock, comprising a lock housing (7), a catch (9) adapted to be retractable by means of a handle into the lock housing (7) against an outward thrust spring (19), a bolt (29) displaceable between a retracted position and an outwardly thrust position, and a setting drive (37, 41, 43), the setting drive (37, 41, 43) comprises an electric motor (37), a gearing (41, 43) coupling the electric motor (37) for both directions of movement with the bolt (29) and an engaging device (75, 77) for the catch (9), which on driving of the gearing (41, 43) in the direction of retraction of the bolt (29) beyond its retracted position entrains the catch (9) in the retraction direction, the setting drive (37), 41, 43) comprises a control part (43) guided displaceably on the lock housing (7) transversely of the directions of movement of the bolt (29), said control part is coupled with the bolt (29) through a cam gearing (61, 63) with thrust faces extending obliquely of the directions of movement of the bolt (29) and of the control part (43), and in its movement allocated to the direction of retraction of the bolt (29) is movable beyond the position allocated to the retracted bolt (29), entraining the catch (9), the gearing (41, 43) is formed as toothed-wheel gearing with an output pinion (57) meshed with a rack toothing (59) extending on the control part (43) in its direction of displacement and the control part (43) in its direction of displacement and the control part (43) is displaceable, for the retraction movement of the bolt (29), transversely of the direction of movement of the catch (9) towards the latter and comprises, adjacent to the catch (9), an engaging stop (75) which can be brought, when the bolt (29) is in the retracted position, into engagement with the catch (9), the control part (43) is guided for displacement in a guide (5, 33, 35), so that when the bolt (29) is in the retracted position, a pivoting movement of the control part (43) is permitted in the direction of retraction of the catch (9), and a zone of the rack toothing (59) drives the control part (43) beyond the position allocated to the retracted bolt (29) and extends transversely of another zone of the rack toothing (59) driving the bolt (29), and the region of the rack toothing (59) driving the control part (43) beyond the position allocated to the retracted bolt (29) merges by way of a concavely curved section (78) into the bolt drive zone of the rack toothing (59).

* * * * *